US006491559B1

(12) United States Patent
Rasmussen et al.

(10) Patent No.: US 6,491,559 B1
(45) **Date of Patent: *Dec. 10, 2002**

(54) ATTACHING SPACERS IN A DISPLAY DEVICE

(75) Inventors: Robert T. Rasmussen, Boise, ID (US); David A. Cathey, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/438,936

(22) Filed: Nov. 12, 1999

Related U.S. Application Data

(63) Continuation of application No. 08/764,485, filed on Dec. 12, 1996, now Pat. No. 5,984,746.

(51) Int. Cl.[7] ..... H01J 9/24
(52) U.S. Cl. ..... 445/24
(58) Field of Search ..... 445/24

(56) References Cited

U.S. PATENT DOCUMENTS

| | | | | |
|---|---|---|---|---|
| 3,424,909 A | | 1/1969 | Rougeot | 250/207 |
| 3,979,621 A | | 9/1976 | Yates | 313/105 CM |
| 3,990,874 A | | 11/1976 | Schulman | 65/4 B |
| 4,091,305 A | | 5/1978 | Poley et al. | 313/220 |
| 4,183,125 A | | 1/1980 | Meyer et al. | 29/25.15 |
| 4,451,759 A | | 5/1984 | Heynisch | 313/495 |
| 4,705,205 A | | 11/1987 | Allen et al. | 228/180.2 |
| 4,732,838 A | | 3/1988 | Sechi et al. | 430/198 |
| 4,923,421 A | | 5/1990 | Brodie et al. | 44/24 |
| 4,940,916 A | | 7/1990 | Borel et al. | 313/306 |
| 5,070,282 A | | 12/1991 | Epsztein | 315/383 |
| 5,136,764 A | | 8/1992 | Vasquez | 29/25.01 |
| 5,151,061 A | | 9/1992 | Sandhu | 445/24 |
| 5,205,770 A | | 4/1993 | Lowrey et al. | 445/24 |
| 5,229,691 A | | 7/1993 | Shichao et al. | 315/366 |
| 5,232,549 A | | 8/1993 | Cathey et al. | 456/633 |
| 5,324,602 A | | 6/1994 | Inada et al. | 430/23 |
| 5,329,207 A | | 7/1994 | Cathey et al. | 315/169.1 |
| 5,342,477 A | | 8/1994 | Cathey | 156/643 |
| 5,342,737 A | | 8/1994 | Georger, Jr. et al. | 430/324 |
| 5,347,292 A | | 9/1994 | Ge et al. | 345/74 |
| 5,371,433 A | | 12/1994 | Home et al. | 313/495 |
| 5,374,868 A | | 12/1994 | Tjaden et al. | 313/310 |
| 5,391,259 A | | 2/1995 | Cathey et al. | 156/643 |
| 5,413,513 A | | 5/1995 | Home et al. | 445/24 |
| 5,445,550 A | | 8/1995 | Xie et al. | 445/24 |
| 5,448,131 A | | 9/1995 | Taylor et al. | 313/309 |
| 5,449,970 A | | 9/1995 | Kumar et al. | 313/495 |
| 5,486,126 A | | 1/1996 | Cathey et al. | 445/25 |
| 5,672,083 A | * | 9/1997 | Curtin et al. | 445/25 |
| 5,716,251 A | | 2/1998 | Watkins | 445/24 |
| 5,730,636 A | * | 3/1998 | Stansbury | 445/25 |

FOREIGN PATENT DOCUMENTS

| | | |
|---|---|---|
| EP | 690472 A1 | 1/1996 |
| JP | 2-165540 A | 6/1990 |
| JP | 3-179630 A | 8/1991 |

* cited by examiner

*Primary Examiner*—Kenneth J. Ramsey
(74) *Attorney, Agent, or Firm*—Hale and Dorr LLP

(57) ABSTRACT

A faceplate in a flat panel display has attachment sites made with a method that includes steps of mixing frit and photoresist to form a mixture, applying the mixture to the substrate, softbaking the substrate and mixture, and exposing and developing the resist to define adhesion sites. Spacers are then attached to the faceplate at the adhesion sites.

29 Claims, 3 Drawing Sheets

ATTACHING SPACERS IN A DISPLAY DEVICE

CROSS-REFERENCE TO RELATED APPLICATION

This application is a continuation of Ser. No. 08/764,485, filed now Dec. 12, 1996, U.S. Pat. No. 5,984,746.

STATEMENT OF GOVERNMENT RIGHTS

This invention was made with government support under contract No. DABT63-93-C0025 awarded by Advanced Research Projects Agency (ARPA). The Government has certain rights in this invention.

BACKGROUND OF THE INVENTION

The present invention relates to displays, and more particularly to processes for creating spacer attachment sites for a field emission display (FED).

Referring to FIG. 1, in a typical FED (a type of flat panel display), a backplate (cathode) 21 has a substrate 10, such as glass, on which conductive layers 12, such as doped polycrystalline silicon or aluminum, are formed. Conical emitters 13 are formed on conductive layers 12. A dielectric layer 14 surrounds emitters 13, and a conductive extraction grid 15 is formed over dielectric layer 14. When a voltage differential from a power source 20 is applied between conductive layers 12 and grid 15, electrons 17 bombard pixels 22 of a phosphor coated faceplate (anode) 24. Faceplate 24 has a transparent dielectric layer 16, preferably glass, a transparent conductive layer 26, preferably indium tin oxide (ITO), a black matrix grille (not shown) formed over conductive layer 26 to define regions, and phosphor coating over the regions defined by the grille.

Backplate 21 and faceplate 24 are spaced very close together in a vacuum sealed package. In operation, there is a potential difference on the order of 1000 volts between conductive layers 12 and 26. Electrical breakdown must be prevented in the packaged FED, while the spacing between the plates must be maintained at a desired thinness for high image resolution.

A small area display, such as one inch (2.5 cm) diagonal, may not require additional supports or spacers between faceplate 24 and backplate 21 because glass substrate 16 in faceplate 24 can support the atmospheric load. For a larger display area, several tons of atmospheric force are exerted on the faceplate, thus making spacers important if the faceplate is to be thin and lightweight.

SUMMARY OF THE INVENTION

The present invention includes methods of making spacers in displays and particularly in field emission displays (FEDs). One method includes steps of mixing frit and photoresist together to form a mixture, applying the mixture to a surface of a portion of a faceplate or backplate, removing portions of the mixture to form adhesion sites at desired locations, and attaching spacers at the adhesion sites. In preferred embodiments, the mixture has about 2% frit and 98% photoresist and is provided on a grille and a transparent conductive layer of a faceplate, and is then removed except over portions of the grille.

With the method of the present invention, precise adhesion sites can be conveniently formed. Other features and advantages will become apparent from the following detailed description, drawings, and claims.

DETAILED DESCRIPTION

According to the present invention, frit (a glass powder) and a compatible photoresist are mixed together to form a mixture. Conventional frits, such as Corning 7572 or 7575, and known positive and negative photoresists, such as OCG SC negative photoresists, can be used. For Corning 7572 or Corning 7575, a resist such as OCG SC100 or a polyvinyl alcohol (PVA) based resist could be used. In an exemplary mixture of Corning 7572 and OCG SC100, the mixture is preferably about 1–5% by weight of frit and about 95–99% by weight of resist, and more preferably about 2% by weight of frit and about 98% by weight of resist. The resist and frit are mixed with a low shear technique until a substantially homogeneous mixture without bubbles or froth is obtained. For Corning 7572 and an OCG SC negative resist, the combination can be mixed for about 30–60 minutes.

Figure 2:
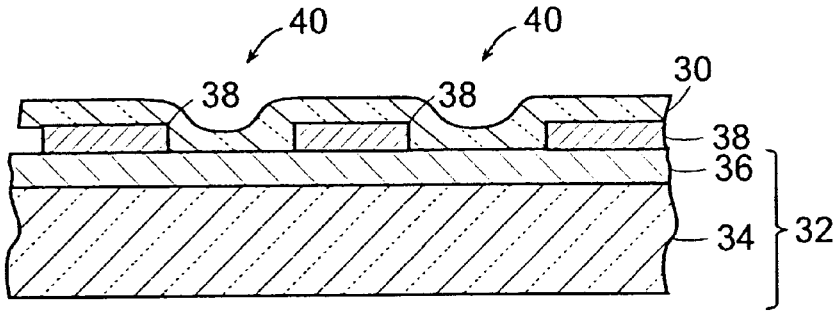
FIG. 2 is a cross-sectional view of a faceplate covered with a layer of frit and photoresist.

Referring to FIG. 2, mixture 30 of frit and photoresist is applied with an even thickness to a faceplate 32 by using known techniques, such as spin coating or spraying. Faceplate 32 has a transparent dielectric layer 34, preferably glass, and a transparent conductive layer 36, such as tin oxide or indium tin oxide (ITO), coating dielectric layer 34. Over conductive layer 36 is a patterned grille 38 made of an opaque, non-reflective material, such as cobalt oxide, manganese oxide, or diaqueous graphite (DAG). Grille 38 defines regions 40 where phosphor particles will later be coated. Mixture 30 thus covers grille 38 and regions 40 (which are not covered by grille 38). After applying the mixture to faceplate 32, the assembly of faceplate 32 and mixture 30 is heated (softbaked) to cure the resist. If the mixture uses OCG SC negative resist, the substrate is heated to about 80–100° C. for a period of about 5–20 minutes.

Figure 3:
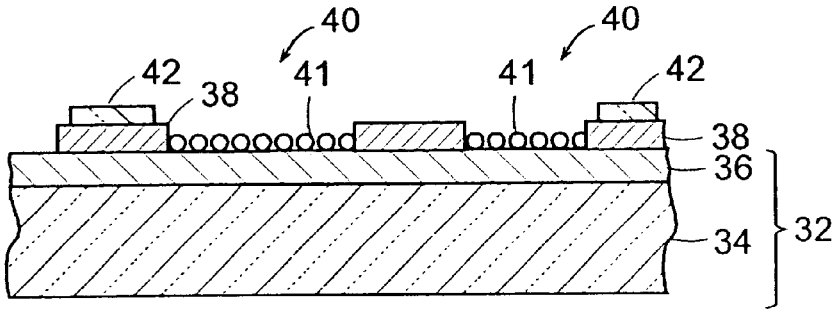
FIG. 3 is a cross-sectional view of the faceplate of FIG. 2 after the layer has been selectively etched and phosphor has been deposited.

Referring to FIG. 3, the resist is then exposed and developed to create desired regions of the mixture of frit and cured photoresist that serve as adhesion sites 42. Exposure is performed according to known techniques, such as using an aligner to align a mask with the assembly and then exposing the masked assembly with known methods, such as projection lithography or contact printing. E-beam lithography could also be used. After exposure, the mixture is developed using an appropriate developing solvent, such as WNRD. The mixture can be developed with a dip-develop technique or a spray-develop technique. For the dip-develop technique, faceplate 32 with mixture 30 is immersed in developer for about two minutes with gentle agitation, and is then removed and put into a second tank with a rinse for about 30 seconds. It is then removed from the second tank and allowed to air dry, or it can be dried with forced gases and/or gentle heat. The developing and rinse times an vary depending on the thickness of the mixture, the softbake process, and ther parameters. The developing typically takes about 1.5 to 3 minutes, and he rinse lasts for about 30 seconds.

Figure 4:
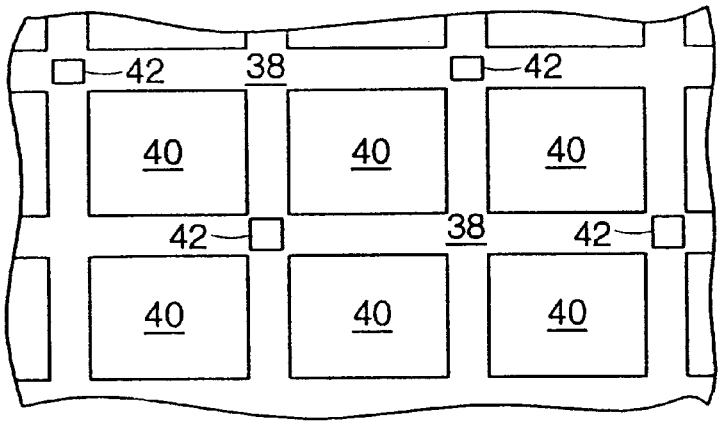
FIG. 4 is a plan view of the faceplate of FIG. 3.

These steps produce a well defined, precise pattern of sites 42 with frit ixed with cured photoresist. The photoresist thus serves to bind the frit to the underlying faceplate. As shown in exemplary FIGS. 3–4, sites 42 are formed at desired alternating intersections of rows and columns of grille 38. The sites could be formed at all intersections or at fewer intersections, or on portions of grille 38 between intersections. The number of adhesion sites with spacers will depend on the strength of the spacers and the size of the display.

After the frit mixed with cured photoresist is formed on the substrate, a glazing step may be performed to help the frit stick together, and to burn off organics in the mixture. This step is typically performed at about 400–450° C., but the temperature could be different depending on the frit used.

Figure 6:
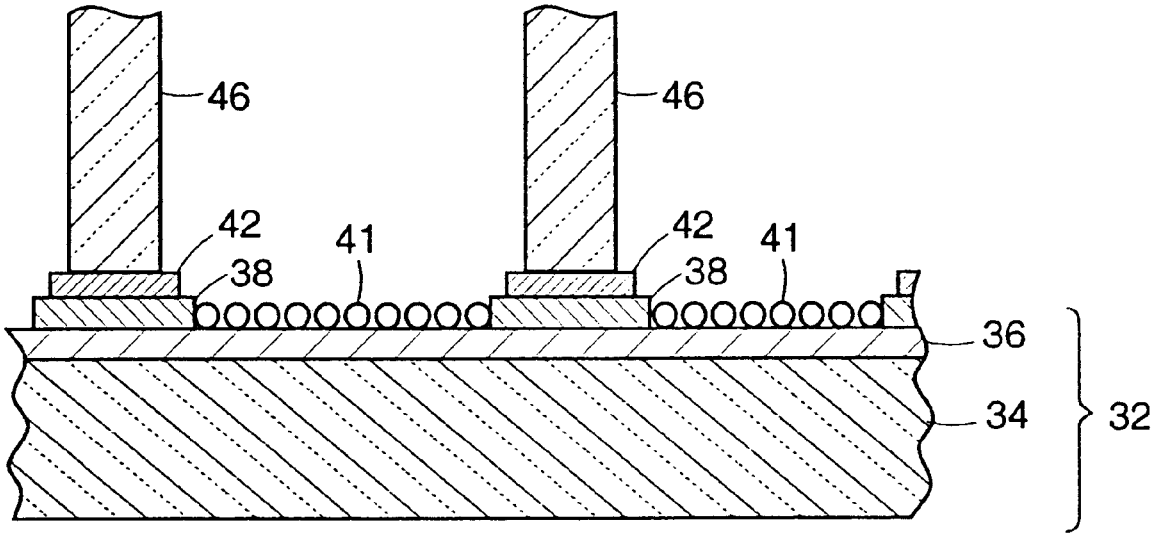
FIG. 6 is a plan view illustrating a bundle of spacers over an adhesion site on a faceplate.
Figure 5:
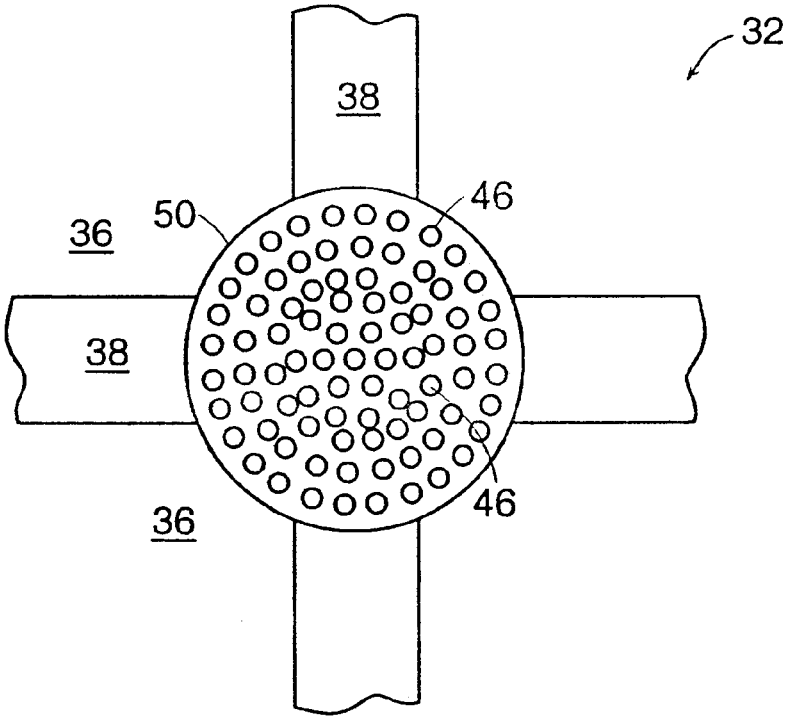
FIG. 5 is a cross-sectional view of the faceplate of FIG. 3 with spacers attached.

Referring to FIGS. 5 and 6, spacers 46 are then attached to faceplate 32 with the frit serving as the adhesive. One way to attach spacers is to provide glass spacers in bundles with binder fibers as described in detail in U.S. Pat. No. 5,486,126, and in application Ser. No. 08/528,761, both of which are expressly incorporated herein by reference for all purposes. Large numbers of spacers 46 are formed in bundles 50 and clamped with uniform pressure to the faceplate at adhesion sites 42 at the intersection of rows and columns of grille 38. Bundles 50 and faceplate 32 are then heated sufficiently to soften the frit. When cooled, some spacers 46 in bundle 50 are firmly attached to grille 38 at sites 42, and thus extend perpendicularly away from the faceplate. The spacers can then be further processed, e.g., with a planarization technique, such as chemical-mechanical planarization (CMP).

Figure 1:
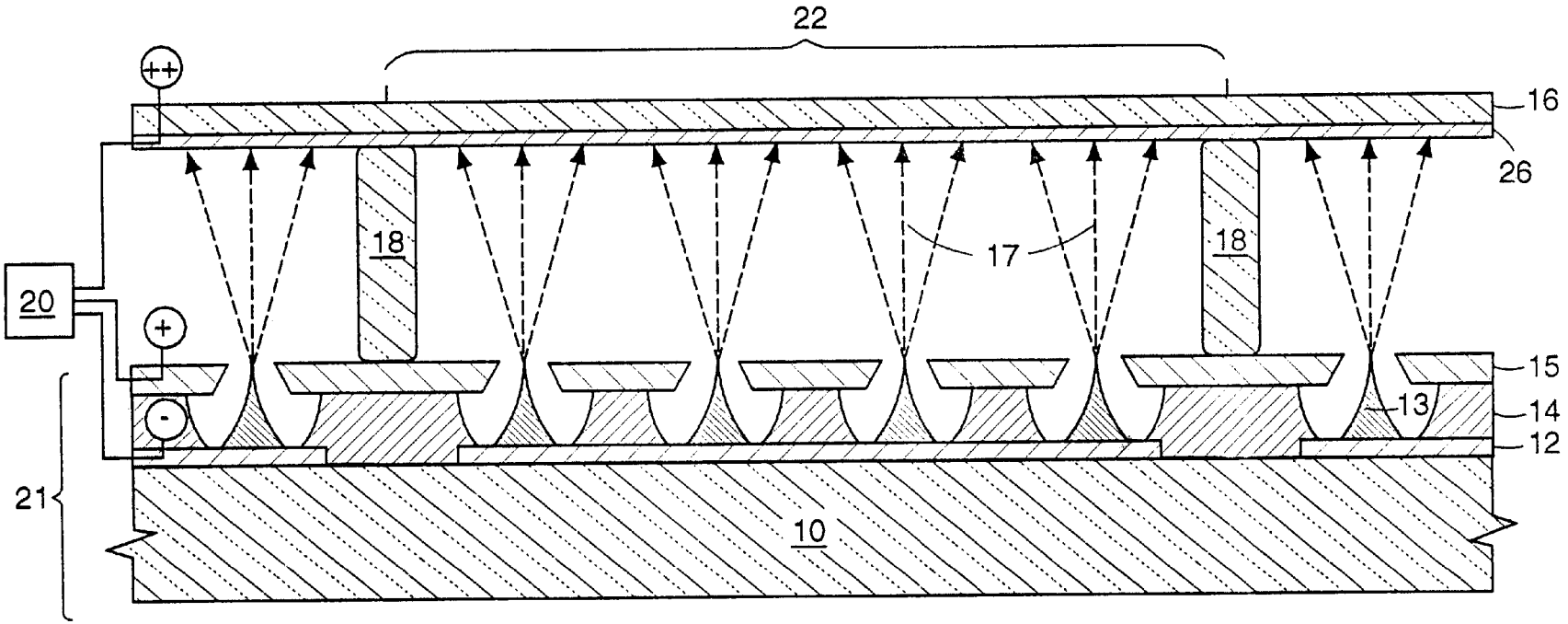
FIG. 1 PRIOR ART
FIG. 1 is a cross-sectional view of a known FED.

The faceplate with spacers is then assembled with the backplate/cathode in a vacuum-sealed package in a generally known manner to produce a display, such as a display similar in principle to that in FIG. 1. The spacers extend to and rest on the extraction grid of the cathode, but preferably are not held there with adhesive; rather, the pressure differential holds the spacers in place.

Having described certain processes according to the present invention, it should be apparent that changes can be made without departing from the scope of the invention as defined by the appended claims. The mixture can also be provided to a backplate, preferably after conductive layers, a silicon layer, an oxide, and a conductive grid layer are formed, and prior to etching to form the emitter cones. The resulting adhesion sites are preferably on the conductive extraction grid. The faceplate need not have a matrix grille, and if it does, spacers can be provided before or after the grille is formed. While a devitreous frit is preferred for the mixture, a vitreous frit can be used.

What is claimed is:

1. A method of making a display having a faceplate and a backplate, the method comprising:

applying a mixture of a bonding material in powder form and a patternable and developable material to one of the faceplate and the backplate;

removing portions of the mixture to leave desired locations of the mixture on the one of the faceplate and the backplate;

attaching spacers to the one of the faceplate and the backplate at the desired locations; and assembling together the faceplate and backplate so that the faceplate and backplate are substantially parallel and the spacers extend from the faceplate to the backplate.

2. The method of claim 1, wherein the removing includes exposing the mixture, and developing the mixture to produce a pattern of regions of the mixture.

3. The method of claim 2, further comprising glazing after the developing, the glazing including heating the mixture to a sufficient temperature to burn off organics in the mixture.

4. The method of claim 1, wherein the applying includes applying the mixture over a faceplate having a transparent dielectric layer, a transparent conductive layer over the dielectric layer, and a grille over the conductive layer, the applying being performed so that the mixture covers the grille and portions of the conductive layer not covered by the grille.

5. The method of claim 4, wherein the mixture has 1–5% of sealing material and 95–99% of the patternable and developable material.

6. The method of claim 1, wherein the attaching includes applying pressure to a bundle of spacers against the adhesion sites, and heating the spacers and the mixture at the adhesion sites sufficiently to soften the bonding material.

7. The method of claim 6, further comprising, after the spacers are attached, planarizing the spacers.

8. The method of claim 1, wherein the applying includes spin coating the mixture.

9. The method of claim 1, wherein the applying includes spraying the mixture.

10. The method of claim 1, wherein the mixture has 1–5% of sealing material and 95–99% of the pattemable and developable material.

11. The method of claim 1, wherein the bonding material includes a devitreous glass powder.

12. The method of claim 1, wherein the applying includes applying the mixture over a faceplate having a transparent dielectric layer, a transparent conductive layer over the dielectric layer, and a grille over the conductive layer in rows and columns, the desired locations being at intersections of the rows and columns of the grille.

13. The method of claim 1, wherein the applying includes applying the mixture on a conductive grid layer of a backplate, the backplate having a substrate, a conductive layer over the substrate, a dielectric layer over the conductive layer, and a conductive grid layer over the dielectric layer.

14. A method of making a field emission display (FED) comprising:

forming a transparent conductive layer over a transparent dielectric layer;

forming a grille over the conductive layer to define pixel regions;

mixing together a bonding material in powder form and a patternable and developable material to form a mixture;

providing the mixture over the grille and over the defined regions;

removing portions of the mixture to leave adhesion sites at desired locations on the grille;

attaching spacers to the grille at the adhesion sites; and coating the defined regions with phosphor.

15. The method of claim 14, wherein the removing includes exposing the mixture, and developing the mixture to produce a pattern of regions of the mixture.

16. The method of claim 15, wherein the developing includes providing the display with the mixture in a developing solvent, and thereafter rinsing the display with the mixture at the desired adhesion sites.

17. The method of claim 14, wherein the attaching step includes applying pressure to a number of spacers against the adhesion sites, and heating the spacers and the mixture at the adhesion sites to soften the bonding material.

18. The method of claim 14, further comprising, after the mixing and before the providing, softbaking the mixture to cure the mixture.

19. The method of claim 14, wherein the mixing together includes mixing 1–5% bonding material and 95–99% patternable and developable material.

20. The method of claim 14, further comprising, after the providing, heating the mixture sufficiently to burn off organics in the mixture.

21. The method of claim 14, wherein the attaching includes positioning a bundle of spacers against the grille and conductive layer and applying pressure to the bundle.

22. The method of claim 21, further comprising planarizing the spacers after the spacers are attached.

23. A method of making a backplate of a display comprising:

forming a cathode with a substrate, a conductive layer over the substrate, a layer for electron emitters on the conductive layer, a dielectric layer on the conductive layer, and a conductive grid layer over the dielectric layer;

mixing together a bonding material in powder form and a patternable and developable material to form a mixture;

providing the mixture over the conductive grid;

removing portions of the mixture to leave adhesion sites at desired locations on the conductive grid; and attaching spacers to the conductive grid.

24. The method of claim 23, wherein the mixing together includes mixing 1–5% bonding material and 95–99% patternable and developable material.

25. The method of claim 23, wherein the bonding material includes frit, and the patternable and developable material includes photoresist.

26. The method of claim 23, wherein the removing includes exposing the mixture, and developing the mixture to produce a pattern of regions of the mixture.

27. The method of claim 26, wherein the developing includes providing the display with the mixture in a developing solvent, and thereafter rinsing the display with the mixture at the desired adhesion sites.

28. The method of claim 23, further comprising, after the providing, heating the mixture sufficiently to burn off organics in the mixture.

29. The method of claim 23, wherein the mixing, providing, removing, and attaching are performed before an etching process to form the electron emitters as conical structures.

* * * * *